US006158222A

United States Patent [19]

Retallick

[11] Patent Number: 6,158,222

[45] Date of Patent: Dec. 12, 2000

[54] CATALYTIC COMBUSTOR FOR A GAS TURBINE

[76] Inventor: William B. Retallick, 1432 Johnny's Way, West Chester, Pa. 19382

[21] Appl. No.: 09/327,430

[22] Filed: Jun. 7, 1999

[51] Int. Cl.[7] ..... F02C 1/02

[52] U.S. Cl. ..... 60/723; 431/7

[58] Field of Search ..... 60/723; 431/7

[56] References Cited

U.S. PATENT DOCUMENTS

| | | | |
|---|---|---|---|
| 4,402,871 | 9/1983 | Retallick . | |
| 4,576,800 | 3/1986 | Retallick . | |
| 4,748,838 | 6/1988 | Cornelison . | |
| 5,202,303 | 4/1993 | Retallick et al. . | |
| 5,328,359 | 7/1994 | Retallick . | |
| 5,346,389 | 9/1994 | Retallick et al. | 431/7 |
| 6,060,173 | 5/2000 | Retallick et al. | 428/593 |

*Primary Examiner*—Charles G. Freay
*Attorney, Agent, or Firm*—William H. Eilberg

[57] ABSTRACT

A catalytic combustor is formed of a plurality of segments which are enclosed within a canister. Each segment includes a metal strip which is folded back and forth upon itself. The strip is coated with catalyst on only one side, and the strip is brazed or welded to the canister only on the uncoated side. The segments of the combustor substantially fill the cross-section of the canister, but these segments are not physically joined to each other. The structure described above makes it possible to make the combustor relatively flat, having a length to diameter ratio of 0.25 or less. The catalytic combustor of the present invention is especially useful in a gas turbine, where space is limited, and where catalytic combustion is useful in preventing the formation of NOx.

15 Claims, 3 Drawing Sheets

CATALYTIC COMBUSTOR FOR A GAS TURBINE

FIELD OF THE INVENTION

The present invention relates to the field of gas turbines, and provides a catalytic combustor which prevents or reduces the formation of nitrogen oxides (NOx) in a gas turbine.

BACKGROUND OF THE INVENTION

A conventional gas turbine burns a hydrocarbon fuel, such as natural gas, by mixing the fuel with air, and uses the combustion gas to drive the turbine. The rotary motion of the turbine can then operate a generator, such as in an electric power plant.

The higher the temperature of the combustion gas entering the turbine, the higher the efficiency of the turbine. With present-day alloys in the turbine blades, this temperature is limited to 1200–1300° C. However, absent perfect mixing of fuel and air, there will be islands of high fuel concentration where the temperature is high enough to form NOx. With improved mixing of fuel and air, the formation of NOx can be reduced to about 25 ppm with gas fuel and to about 40 ppm with liquid fuel. Catalytic combustion offers the possibility of reducing the NOx concentration to less than 10 ppm, which is already a requirement in some localities. With a catalytic combustor of the present invention, the temperature entering the turbine is the same as before, so that the efficiency of the turbine is not diminished. The benefit of the present invention is that the "window" of time and temperature which produces NOx is avoided, so that the output of NOx is below 10 ppm.

Temperature control in a catalytic combustor has been a serious problem. If the temperature in the combustor exceeds about 1000° C., the catalyst will be destroyed. This problem can be at least partly solved by providing a combustor formed of strips, wherein the catalyst coating is provided on only one side of each strip. The latter structure is more fully described in U.S. Pat. No. 5,202,303, the disclosure of which is incorporated by reference herein.

It has been known to form a metal catalyst support by laying a corrugated strip of metal on a flat strip of metal, and winding the two strips upon themselves to make a spiral. It has also been known to fold a single strip back and forth upon itself to form the combustor. In the latter case, the positions of the folds can be chosen such that the combustor will have virtually any cross-sectional shape that is desired. More details about the latter techniques are provided in U.S. Pat. Nos. 4,402,871 and 4,576,800, the disclosures of which are incorporated by reference herein.

In a gas turbine, there is generally very little space within which to fit a catalytic combustor. Because of space limitations, it is desirable that the combustor be very thin. However, for a combustor formed of a single folded strip, or a combustor formed by winding a strip into a spiral, the folds or turns are likely to telescope outwardly, due to the force of the combustion gas, thereby destroying the combustor.

The present invention provides a catalytic combustor which solves the above-described problems, and which is practical for use in a gas turbine.

SUMMARY OF THE INVENTION

The catalytic combustor of the present invention includes a plurality of segments. Taken together, the segments substantially fill the cross-sectional area of a canister or shell which houses the combustor. Each segment is made by folding a strip of metal foil back and forth upon itself. The foil has corrugations which maintain the spacing between the folds. Only one side of the foil is coated with a combustion catalyst.

The folds of each segment are brazed or welded to the canister at points of contact between the folded strips and the canister. The strips are arranged such that these points of contact occur between the uncoated side of the strip and the canister. Thus, no brazing or welding is done on the side of the strip which is coated. The strips of the various segments touch each other, but, in one embodiment, they are not physically joined; the only means for holding the segments in place is the brazing or welding of the strips to the canister. In an alternative embodiment, the entire structure can be formed of a single strip. The latter alternative does not add significant rigidity, but may be more convenient to manufacture by automated means. In the latter alternative, for practical purposes, one can still say that each segment is made from a separate, individual strip.

The outer shell is disposed within a combustion chamber of a gas turbine. The length, i.e. the thickness, of the combustor is relatively short, such that the ratio of the length to the diameter of the shell is less than about 0.25, or, more preferably, less than about 0.20.

The present invention therefore has the primary object of providing a catalytic combustor for a gas turbine.

The invention has the further object of providing a metal honeycomb structure for use as a catalytic combustor in a gas turbine.

The invention has the further object of providing a catalytic combustor which is very thin, and which can therefore fit conveniently within a gas turbine.

The invention has the further object of providing a catalytic combustor made from a folded strip of metal, wherein the folds of the combustor are not likely to telescope outwardly.

The invention has the further object of providing a gas turbine which includes a catalytic combustor.

The invention has the further object of providing a gas turbine which minimizes the formation of NOx.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1C:
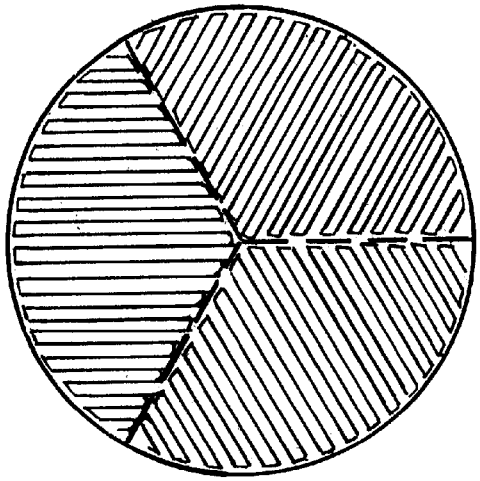
FIGS. 1A, 1B and 1C show end views of three different configurations of a catalytic combustor made according to the present invention.
Figure 1B:
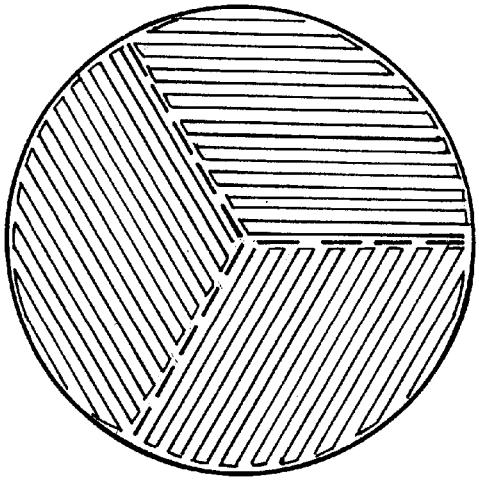
Figure 1A:
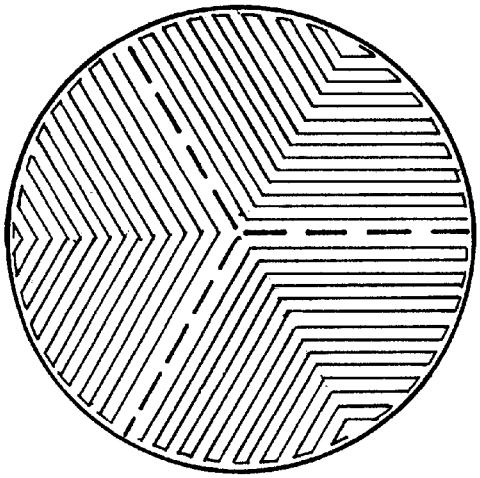

FIGS. 1A, 1B, and 1C provide cross-sectional views of various embodiments of a catalytic combustor made according to the present invention. The combustor includes two or more segments. In FIGS. 1A, 1B, and 1C, each combustor defines three segments. Each segment is formed of a strip of metal foil which is folded back and forth upon itself. The foil has corrugations (not shown in FIGS. 1A–1C) which maintain the spacing between the folds. The figures show lines which separate the segments; these lines are inserted only for clarity of illustration, and do not represent actual physical partitions. Thus, portions of the strip defining one segment will, in general, contact portions of the strip defining an adjacent segment.

In the present invention, the strips forming the catalytic combustor are coated with a catalyst on only one side of the strip. The outer folds of the strips are brazed or welded to the inside of a canister or shell which houses the combustor. Each strip is arranged such that its uncoated side is the side on the outside of a fold located at the periphery of the combustor. Thus, the strip is brazed or welded to the canister at its uncoated side. The strip touches the canister at points of contact which comprise points at which the strip reverses direction. The strips are not brazed or welded at any points other than along the canister. Thus, while the folded strip of one segment is partly in contact with the folded strip of another segment, the strips of different segments are not physically joined to each other. The strips are held in place only by the brazing or welding to the canister. Taken together, the segments defined by the folded strips occupy substantially all of the cross-sectional area of the canister.

It is also possible to form all of the segments from a single continuous strip. Doing so adds negligible rigidity to the combustor, so for practical purposes, one may still consider each segment to be formed of its own individual strip. The latter alternative may be preferred when the combustor is made by automated equipment.

Figure 2:
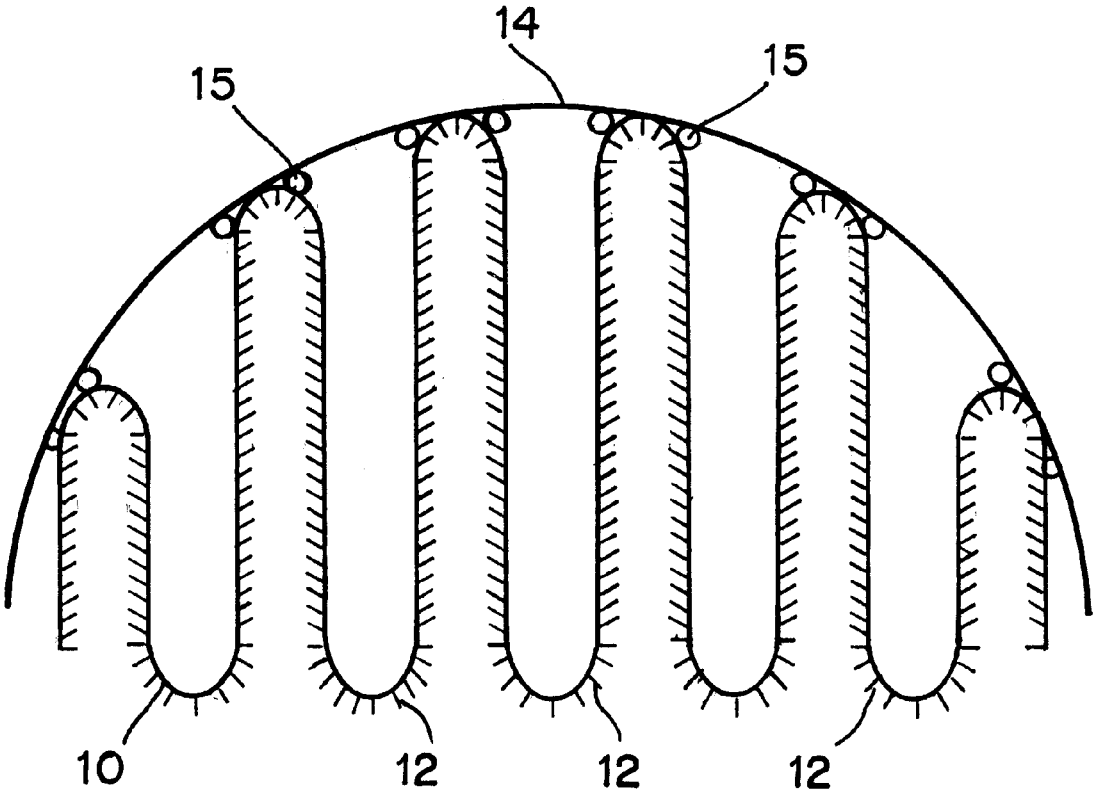
FIG. 2 provides a detail, in cross-section, of a portion of the catalytic combustor of the present invention, showing the brazing or welding of the uncoated side of the strip to the surrounding canister.

FIG. 2 provides a detail of the relationship between the folded strips and the canister. FIG. 2 is intentionally drawn out of scale, and in an exaggerated manner, only for purposes of illustration. The figure shows strip 10 having a catalyst coating 12 on only one side of the strip. The strip touches the inside of canister 14 only on its uncoated side. The strip is brazed or welded to the canister at brazing or welding points 15.

Figure 3:
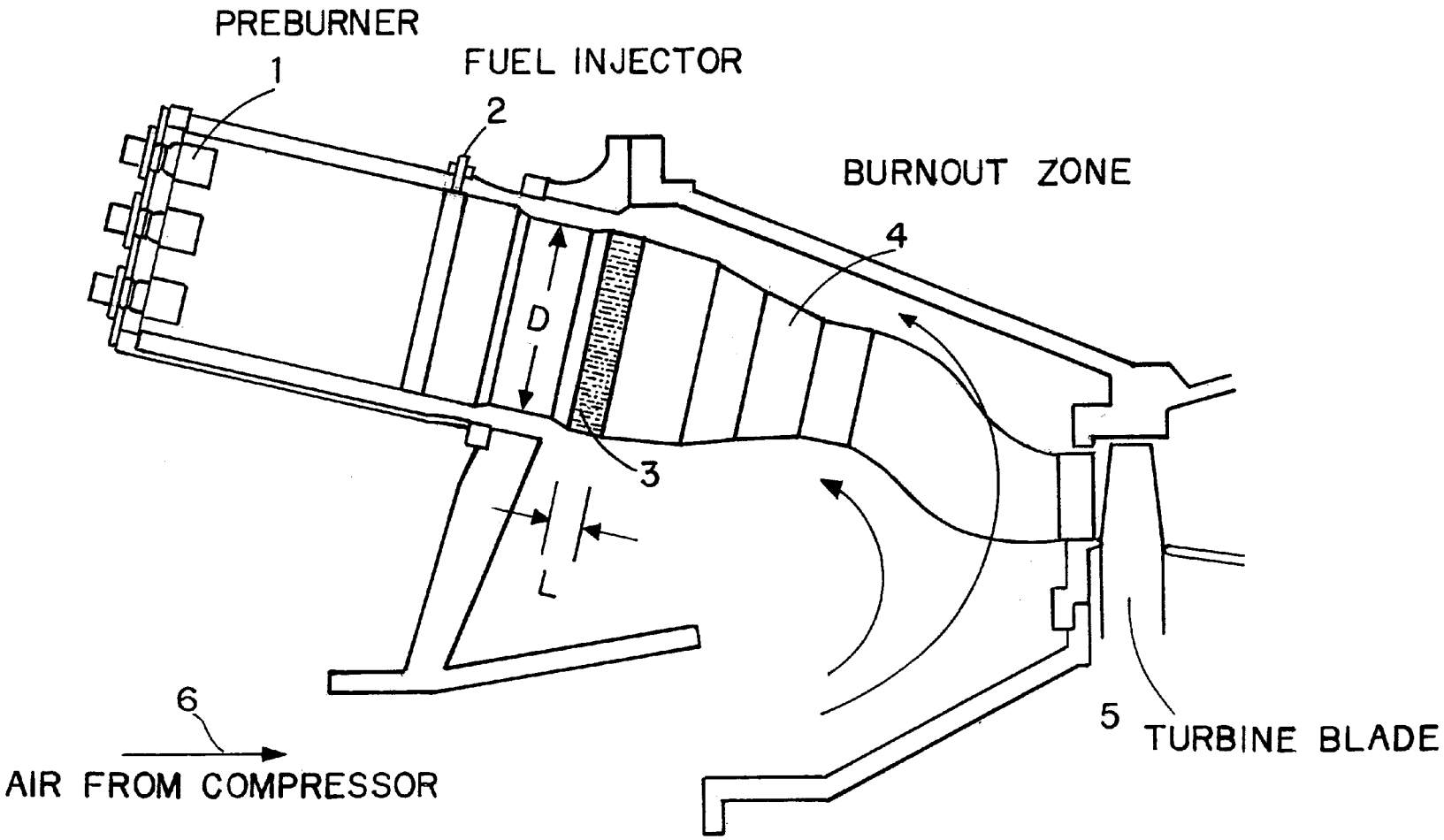
FIG. 3 provides a side view of a portion of a combustor for a gas turbine, showing the use of the catalytic combustor of the present invention.

FIG. 3 shows the catalytic combustor of the present invention as used in a gas turbine. The turbine includes preburner 1, which may be a diffusion flame used to start the combustion process. Fuel is added through fuel injector 2, and air from a compressor enters through inlet 6. Catalytic combustor 3 is placed downstream of the fuel injector, and combustion is completed in burnout zone 4. The combustion area is of generally circular cross-section, so the catalytic combustor is also of circular cross-section, thereby filling the available space. The resulting combustion gases drive turbine blade 5.

FIG. 3 indicates the length L and the diameter D of catalytic combustor 3. In the example shown in FIG. 3, the ratio L/D is approximately 0.13. In general, in the present invention, the ratio L/D should be less than or equal to about 0.25, and, more preferably, less than about 0.20.

The segmentation of the catalytic combustor can be provided in different forms. In FIGS. 1A–1C, the combustor has a circular cross-section. The combustor could be formed with an elliptical, square, triangular, or other cross-section, if desired. In general, the shape of the cross-section of the combustor will be determined by the cross-section of the combustion chamber into which the combustor is to be placed. Combustors having various cross-sections are described in co-pending application Ser. No. 08/832,698, filed Apr. 12, 1997, the disclosure of which is incorporated by reference herein.

Also, the catalytic combustor could be divided into more than the three segments shown in FIGS. 1A–1C. However, in the present invention, there must be at least two segments.

The combustors shown in FIGS. 1B and 1C are especially rigid because the folds have a maximum length which is not greater than the radius of the canister. If the folds are allowed to become longer than this radius, as in FIG. 1A, the structure would be cantilevered to a greater degree, because the folds are affixed only to the canister. In the latter case, the combustor would be less rigid.

The catalytic combustor shown in FIGS. 1A–1C has the further advantage that it facilitates the transfer of heat from the canister of the combustor to the air from the compressor. The folds of the foil act as fins which accomplish this heat transfer. The fins are most effective when they are brazed or welded to the shell. By providing two or more segments, one increases the effective number of fins, as compared with a combustor having only mutually parallel folds. The latter statement is true because, for a segmented combustor, there will be a greater number of folds which touch the canister, as compared with the case wherein the combustor is not segmented.

To work as a catalytic combustor, the metal foil must be coated with a catalyst. The catalyst coating is formed by first coating the foil with a suitable metal oxide, such as alumina, and then impregnating the metal oxide coating with the catalyst metal. The folded metal foil structure then becomes a catalyst support.

For whatever the use, the foil must have corrugations to maintain the spacing between the folds, as is taught, for example, in U.S. Pat. Nos. 4,576,800 and 5,328,359. The corrugations can be straight or they can have a herringbone shape. If the corrugations are straight, they may be inclined to the perpendicular across the strip as shown in U.S. Pat. No. 4,748,838. Such inclination is often referred to as "skew" corrugation. This ensures that when the strip is folded, the corrugation will cross over each other and maintain the spacing.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A catalytic combustor comprising a plurality of segments, each segment of the combustor comprising a strip of metal which is folded back and forth upon itself, the strip being coated with a catalyst on only one side of the strip, the strip having an uncoated side, wherein the combustor is enclosed by a canister having a generally circular cross section, wherein the canister has a length and a diameter, and wherein the ratio of the length to the diameter is less than about 0.25, and wherein the uncoated side of the strip contacts the canister at a plurality of points of contact, and wherein the strip is brazed or welded to the canister at some of said points of contact.

2. The catalytic combustor of claim 1, wherein said points of contact comprise points at which the strip reverses direction.

3. The catalytic combustor of claim 1, wherein the ratio of the length to the diameter is less than about 0.20.

4. The catalytic combustor of claim 1, wherein there are three segments.

5. The catalytic combustor of claim 1, wherein the strip of a given segment is not physically joined to a strip of any other segment.

6. A gas turbine, the turbine including means for injecting fuel and air upstream of a combustion zone, and a catalytic combustor positioned downstream of the fuel and air injecting means, the catalytic combustor comprising a plurality of segments, each segment of the combustor comprising a strip of metal which is folded back and forth upon itself, the strip being coated with a catalyst on only one side of the strip, the strip having an uncoated side, wherein the combustor is enclosed by a canister having a generally circular cross section, wherein the canister has a length and a diameter, and wherein the ratio of the length to the diameter is less than about 0.25, and wherein the uncoated side of the strip contacts the canister at a plurality of points of contact, and wherein the strip is brazed or welded to the canister at some of said points of contact.

7. The gas turbine of claim 6, wherein said points of contact comprise points at which the strip reverses direction.

8. The gas turbine of claim 7, wherein the ratio of the length to the diameter is less than about 0.20.

9. The gas turbine of claim 6, wherein there are three segments.

10. The gas turbine of claim 6, wherein the strip of a given segment is not physically joined to a strip of any other segment.

11. A catalytic combustor comprising:

a) a canister having a generally circular cross-sectional area, wherein the canister has a length and a diameter, and wherein the ratio of the length to the diameter is less than about 0.25, b) the canister having a plurality of segments, said plurality of segments occupying substantially all of the cross-sectional area of the canister, c) each of said segments comprising a strip of metal which is folded back and forth upon itself, the strip being coated with a catalyst on only one side, the strip having an uncoated side, wherein the uncoated side of the strip contacts the canister at a plurality of points of contact, and wherein the strip is brazed or welded to the canister at some of the points of contact.

12. The catalytic combustor of claim 11, wherein said points of contact comprise points at which the strip reverses direction.

13. The catalytic combustor of claim 11, wherein the ratio of the length to the diameter is less than about 0.20.

14. The catalytic combustor of claim 11, wherein there are three segments.

15. The catalytic combustor of claim 11, wherein the strip of a given segment is not physically joined to a strip of any other segment.

* * * * *